US006227971B1

(12) United States Patent
Weiss

(10) Patent No.: US 6,227,971 B1
(45) Date of Patent: May 8, 2001

(54) MULTI-LINE, MULTI-REEL GAMING DEVICE

(75) Inventor: Steven A. Weiss, Las Vegas, NV (US)

(73) Assignee: Casino Data Systems, Las Vegas, NV (US)

( * ) Notice: Subject to any disclaimer, the term of this patent is extended or adjusted under 35 U.S.C. 154(b) by 0 days.

(21) Appl. No.: 09/396,161

(22) Filed: Sep. 14, 1999

(51) Int. Cl.[7] ..... A63F 9/24
(52) U.S. Cl. ..... 463/20; 273/143 R
(58) Field of Search ..... 463/20, 21, 12, 463/13; 273/143 R, 138.1, 138.2

(56) References Cited

U.S. PATENT DOCUMENTS

| | | | | |
|---|---|---|---|---|
| Re. 34,244 | | 5/1993 | Hagiwara . | |
| 4,573,681 | | 3/1986 | Okada . | |
| 4,743,022 | | 5/1988 | Wood . | |
| 4,756,531 | | 7/1988 | DiRe et al. . | |
| 4,836,546 | | 6/1989 | DiRe et al. . | |
| 4,838,552 | | 6/1989 | Hagiwara . | |
| 4,889,339 | | 12/1989 | Okada . | |
| 4,948,134 | | 8/1990 | Suttle et al. . | |
| 5,042,818 | | 8/1991 | Weingardt . | |
| 5,067,712 | | 11/1991 | Georgilas . | |
| 5,083,785 | | 1/1992 | Okada . | |
| 5,332,219 | | 7/1994 | Marnell, II et al. . | |
| 5,393,057 | * | 2/1995 | Marnell, II | 273/85 |
| 5,580,053 | | 12/1996 | Crouch . | |
| 5,584,764 | | 12/1996 | Inoue . | |
| 5,609,524 | | 3/1997 | Inoue . | |
| 5,647,798 | | 7/1997 | Falciglia . | |
| 5,976,016 | * | 11/1999 | Moody et al. | 463/13 |
| 5,984,782 | * | 11/1999 | Inoue | 463/20 |

FOREIGN PATENT DOCUMENTS

| | | |
|---|---|---|
| 2 083 935A | 3/1982 | (GB) . |
| 2 106 293A | 4/1983 | (GB) . |
| 2 112 984A | 7/1983 | (GB) . |
| 2 135 490A | 8/1984 | (GB) . |
| 2 165 385A | 4/1986 | (GB) . |
| 2 242 300A | 9/1991 | (GB) . |
| 2 243 236A | 10/1991 | (GB) . |

OTHER PUBLICATIONS

Scarne, John. Scarne's Encyclopedia of Games. Harper & Row Publishers. New York: 1973. p. 364.*

* cited by examiner

*Primary Examiner*—Valencia Martin-Wallace
*Assistant Examiner*—Julie Kasick
(74) *Attorney, Agent, or Firm*—Bernhard Kreten

(57) ABSTRACT

A gaming device and method that allows a primary display and secondary display to be correlated to the extent that symbols of the primary display have vectors which direct that symbol associated with the vector onto the secondary display. The secondary display remains constant through successive games except to the extent modified by the provision of a symbol vector which mandates a change in the symbol depiction on the secondary game. A bonus screen is provided based on the certain outcome of the primary game.

17 Claims, 6 Drawing Sheets

MULTI-LINE, MULTI-REEL GAMING DEVICE

FIELD OF THE INVENTION

The instant invention is directed specifically to gaming devices which either use mechanical reels in combination with a video depiction or a video which simulates reels in motion along with depictions which are not part of the rotating reels per se, but instead, are thematically related to and change or remain stationary as a function of the occurrence or non-occurrence of certain vector indicia appearing on the reels. A bonus screen can be enabled upon the occurrence of at least one outcome on the reels.

BACKGROUND OF THE INVENTION

Competition in the gaming industry to attract a player and then retain the players interest for protracted periods of time is an increasingly greater challenge. The environment in a casino is typically rich in stimulation, both visual and auditory. As a consequence, it is an ongoing effort to initially attract a player to a given machine and subsequently encourage the player to stay at the machine based on the machine's entertainment value.

Slot machines formed from a plurality of reels which rotate independently of each other, whether mechanical or video depictions of the mechanical reels, are some of the oldest types of games. Each reel has a reel strip. On each reel strip is designated indicia. When related indicia are oriented on a "pay line" that corresponds to an associated pay table displayed elsewhere on the machines, player receive awards.

Such machines have evolved from having a single horizontal pay line centrally disposed on the reel to having a plurality of pay lines, some pay lines located horizontally, some diagonally, others vertically and some in corners.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| U.S. Pat. No. | ISSUE DATE | INVENTOR |
|---|---|---|
| 4,573,681 | March 4, 1986 | Okada |
| 4,743,022 | May 10, 1988 | Wood |
| 4,756,531 | July 12, 1988 | DiRe, et al. |
| 4,836,546 | June 6, 1989 | DiRe, et al. |
| 4,838,552 | June 13, 1989 | Hagiwara |
| 4,889,339 | December 26, 1989 | Okada |
| 4,948,134 | August 14, 1990 | Suttle, et al. |
| 5,042,818 | August 27, 1991 | Weingardt |
| 5,083,785 | January 28, 1992 | Okada |
| 5,067,712 | November 26, 1991 | Georgilas |
| Re 34,244 | May 11, 1993 | Hagiwara |
| 5,332,219 | July 26, 1994 | Marnell, II, et al. |
| 5,580,053 | December 3, 1996 | Crouch |
| 5,584,764 | December 17, 1996 | Inoue |
| 5,609,524 | March 11, 1997 | Inoue |
| 5,647,798 | July 15, 1997 | Falciglia |

FOREIGN PATENT DOCUMENTS

| DOCUMENT NUMBER | DATE | NAME | CLASS | SUB-CLASS* | FILING DATE |
|---|---|---|---|---|---|

-continued

| | | | |
|---|---|---|---|
| GB2083935A | 3/31/82 | Kirk, et al. | 8/24/81 |
| GB2106293A | 4/7/83 | Last | 8/15/81 |
| GB2112984A | 7/27/83 | Edward, et al. | 10/7/82 |
| GB2135490A | 8/30/84 | Straker | 2/19/83 |
| GB2165385A | 4/9/86 | Wain | 10/4/84 |
| GB2242300A | 9/25/92 | Farrell, et al. | 3/24/90 |
| GB2243236A | 10/23/91 | Lynch, et al. | 4/18/90 |

SUMMARY OF THE INVENTION

The instant invention is distinguished over the known prior art in a multiplicity of ways. For example, on the reels that either move mechanically or are simulated via video, as before the indicia on the reels determines awards when the indicia on a pay line corresponds to that which is announced on the pay table. However, in addition, indicia on the reels includes directional vectors which have an effect on a thematically correlated "second" game. The second game has a different degree of "volatility" than the primary reel game where each indicium always changes on successive tries. Instead, the second game only changes as a function of vectors appearing on the primary game. Vectors preferably do not appear on all indicia of the pending game. Thus a player who plays successive games plays can win if a pay line of the secondary game remains constant or improves on the successive play.

Thus, that aspect of the gaming device which appears less volatile rewards a player's successive plays by providing an award associated with this less volatile secondary game. As stated, the use of the vectors on the indicia of the primary reel portion of the game serves as directives for the second game. For example, assume that the reels on the primary game include indicia thereon in the form of the well known "fruit" type game in which the indicia appears as lemons, oranges, cherries, plums and the like, perhaps with wild elements interposed along each reel strip. Assume further that in conjunction with those depictions, some but not all of the reel indicia include either an upwardly or downwardly oriented arrow, signifying a vector.

The less volatile secondary game is preferably optional; therefore a player needs to elect to partake in this secondary game, typically by making an additional wager. Assume that the player has made an additional wager, thereby enabling the features of the secondary game. The vector's appearance on the primary game will effect the secondary game by transferring the symbol associated with the vector (e.g., a cherry cluster) to a pay line of the secondary game. If no vector is present, the symbol on the secondary pay line from a previous game will not change. The significance of the existence or non-existence of vectors is that a player having a winning pay line on the secondary game from a prior game will again be awarded so long as the secondary winning outcome is undisturbed by a vector.

In other words, if the pay line from a previous wager had provided an award in the secondary game, and if the elements constituting the award have not changed on a subsequent wager, that pay line will continue to provide an award to a player until the combination that generates the award has been disturbed by the vector stimulus. Assume that three cherry clusters on a pay line results in an award. If on subsequent spins the three cherries on the optional (secondary) pay line have not been disturbed, they will continue to pay the player until a vector disturbs that orientation. Note also that the nature of the disturbance may enhance the award or diminish the reward. Because not all indicia have vectors, subsequent reel spins are not as likely to not disturb all indicia of the secondary game. Therefore, the secondary game is less volatile when compared to the primary game where all indicia change on each spin.

OBJECTS OF THE INVENTION

Accordingly, the primary object of the present invention to provide a novel and useful gaming device and method therefore.

A further object of the present invention is to provide a device and method as characterized above which encourages ongoing participation by a player by providing at least one potential pay line whose volatility is less than that of the primary game.

A further object of the present invention is to provide a method and apparatus as set forth above which is easy to understand, intuitive in use and provides enhanced entertainment value.

A further object of the present invention is to provide a device and method as delineated above which builds on the knowledge and familiarity that a player has with respect to conventional games.

A further object of the present invention is to provide a method and apparatus as set forth above in which a bonus screen is displayed upon the occurrence of at least one outcome associated with the game in chief.

Viewed from a first vantage point, it is an object of the present invention to provide a gaming device, comprising, in combination: a primary game which includes a plurality of changeable primary indicia each of which changes on successive plays, some of the primary indicia including vector means, and a secondary game having derived indicia taken from the primary indicia as dictated by the vector means, means to elect the secondary game, and means to award a player as a function of correspondence of the indicia with a pay table.

Viewed from a second vantage point, it is an object of the present invention to provide a method for gaming, including the steps of: displaying a primary game after a wager, awarding certain outcomes of the primary game, enabling a secondary game and transferring indicia from the primary game as directed by the primary game, awarding certain outcomes of the secondary game, changing the primary game display based on a subsequent wager, awarding certain outcomes of the primary game, enabling a secondary game and transferring indicia from said primary game as directed by said primary game, awarding certain outcomes of the secondary game.

Viewed from a third vantage point, it is an object of the present invention to provide a gaming device, comprising, in combination: an RXC changeable display including vector indicia which appears on the display, a secondary display having means to receive the vector indicia, and a bonus screen actuated upon the occurrence of at least one outcome from the displays.

These and other objects will be made manifest when considering the following detailed specification when taken in conjunction with the appended drawing figures.

DESCRIPTION OF PREFERRED EMBODIMENTS

Figure 3:
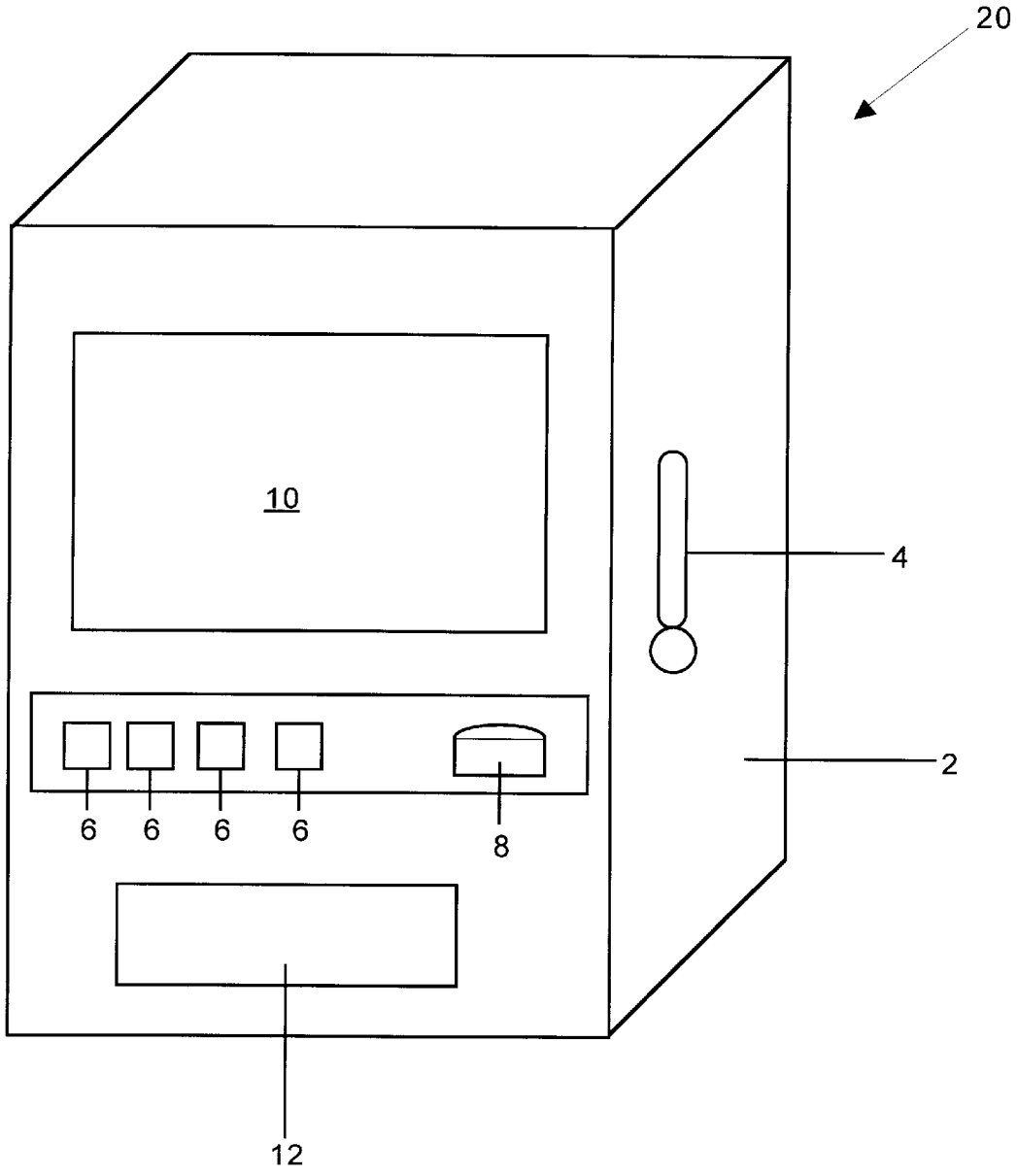
FIG. 3 is a depiction of a gaming machine according to the present invention.

Considering the drawings, wherein like reference numerals denote like parts throughout the various drawing figures, reference numeral 20 of FIG. 3 is directed to the gaming machine according to the present invention.

In its essence, the gaming machine 20 includes a housing 2 configured as a substantially rectangular box-shaped hollow having an interior which receives a display 10 and includes a plurality of decision making buttons 6 projecting through the housing 2. A means for receiving a wager 8 is shown and can be configured as any or all of the following: coin slot, currency receiving mechanism or a card reader. In addition, the device 20 may include a pull handle 4 for engendering successive games. A decision making button 6 typically include "bet one unit", "maximum bet", "spin", "cash out", etc.

Figure 1:
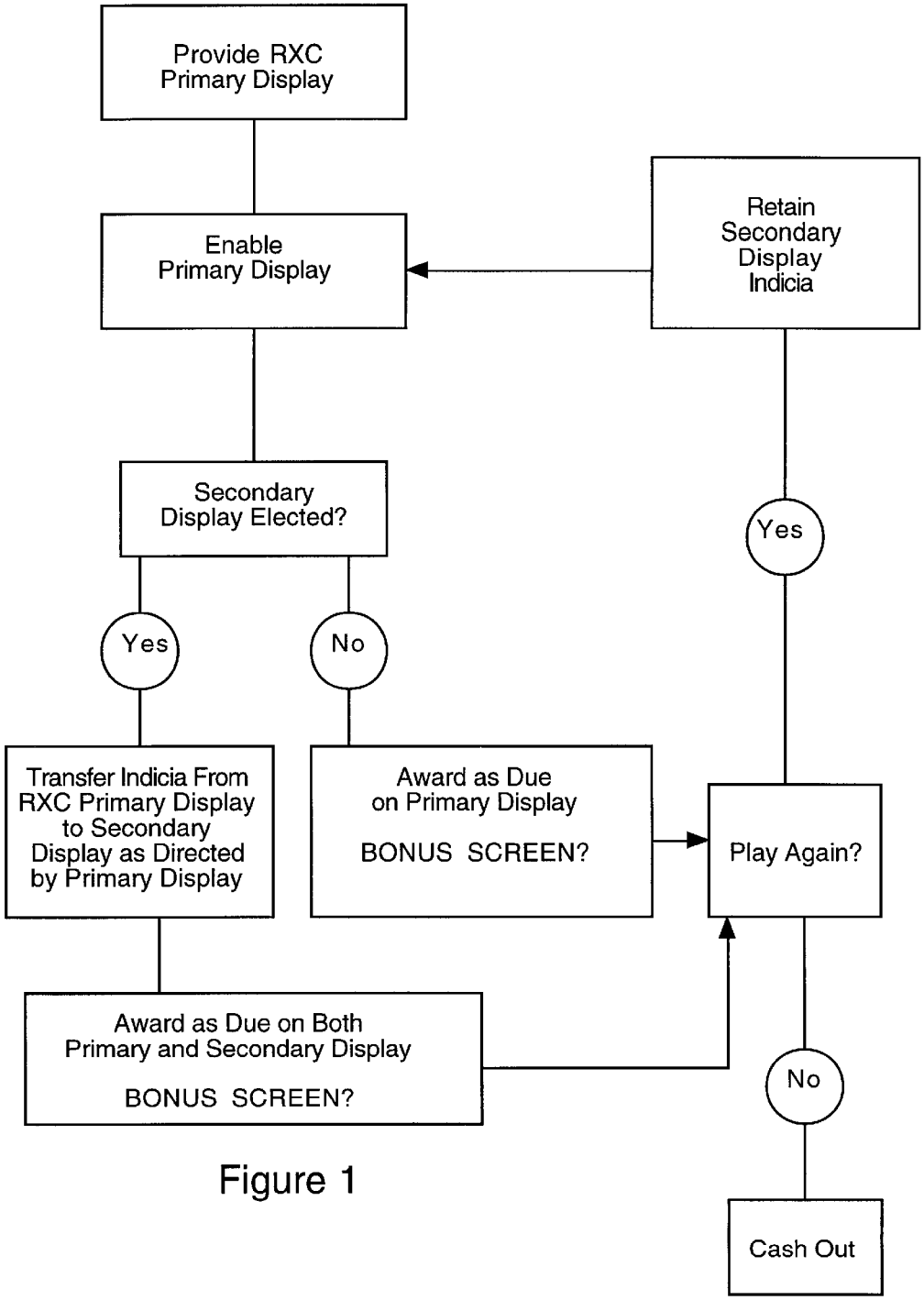
FIG. 1 is a flow chart according to the present invention.
Figure 2:
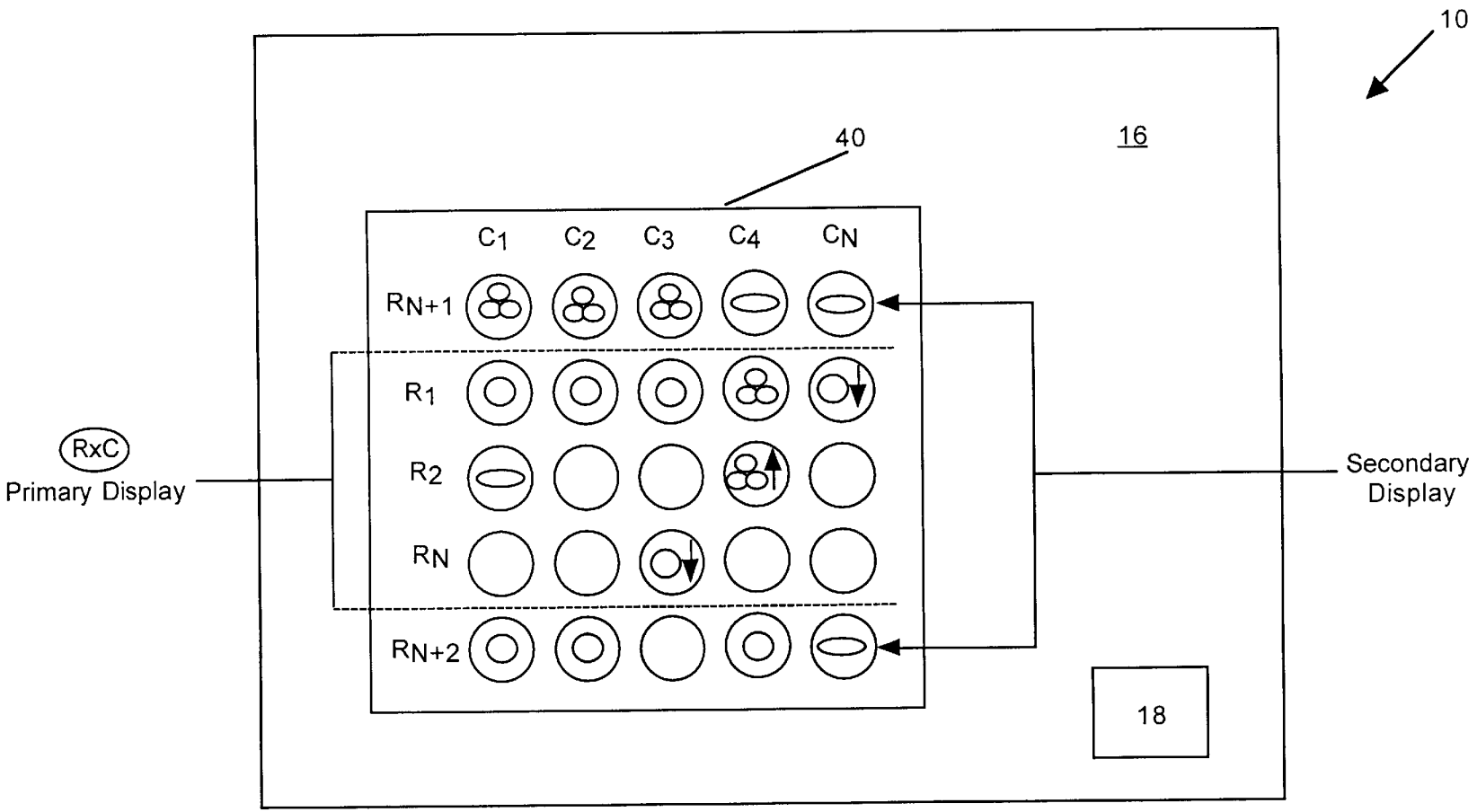
FIG. 2 is a visual depiction of the screen showing both a primary game and a secondary game.

Referring to FIG. 2, a display 10 is shown which includes a primary game (rows $R_1, R_2, \ldots R_N$) and a secondary game (rows $R_{N+1}$, $R_{N+2}$). Typically, the secondary game is only actuated by a bet which is greater than that which is normally required to activate the primary game or display. The display 10 is depicted on a video screen 16 which can have other visual stimulus thereon such as account balance in a message box 18.

The primary display is depicted in FIG. 2 as a three by five matrix having three rows R and five columns C, thereby defining an RXC matrix. However, as suggested in that drawing, more or less rows R and columns C can be fashioned as desired.

Upon initialization, the primary RXC display yields a plurality of symbols or indicia, which when compared with a pay table (e.g. 12 on FIG. 3) defines an award schedule based on correspondence between the display and the pay table. As shown in FIG. 2, row 1 depicts four oranges are displayed. If they correspond with the pay table 12, an award is directly credited to the player's account.

In addition, row 1 includes at column $C_N$ an orange with a vector (arrow) leading downwardly. If the secondary display has been enabled, then that orange would be replicated and placed in row $R_{N+2}$ supplanting the plum which is presently exhibited there. In such a case, row $R_{N+2}$ would have a fourth orange. Attention is also directed to the row $R_N$ which displays another orange having another downward vector. This orange would replace the symbol in the third column $C_3$ of row $R_{N+2}$ providing five oranges. The reward for five oranges would also be determined by the pay table 12. Notice also, that row $R_{N+1}$ is to receive a cherry cluster in column $C_4$ as mandated by the vectored cherry cluster in row $R_2$ column 4 of the primary game. Based on this example, an award may be due according to the pay table for row $R_{N+1}$ having had four cherries along that row.

Assume, however that the cherry cluster in row 2 did not exist and instead another symbol other than a cherry was displayed. Assume also that three cherry clusters are typically awarded a pay out. Although the player had been awarded a pay out for the three cherry clusters in the immediately prior game, an award in this game would still be made to the player for having maintained the three cherry clusters in the present game. Thus, a non-changing secondary display can pay out in successive games even though an award has been made on a previous game. Because the secondary game symbols do not necessarily change in subsequent games, it is less volatile. A player having won in a previous game is therefore urged to play again in the hopes that the prior win is at least not disturbed and hopefully improved.

To summarize, the secondary display can persist in paying an ongoing award during subsequent execution of the games so long as a display exists on the secondary game which corresponds to a pay table. This provides a great inducement to a player to continue playing since the vectors shown in the primary display do not appear on all of the symbols. This defines a secondary game which has substantially less volatility with respect to its changing from successive games and provides in the player an element of entertainment and excitement that a subsequent award will be due because the presently displayed game paid out and is not certain to change on the next game. Of course, it is also within the scope of this game that the cherries shown in row $R_{N+1}$ will be disturbed by a vector from the primary display to something other than that which is recognized as an awardable outcome on the pay table. So for example, had the plum depicted in row 2 column 1 had an upwardly directed vector, it would have supplanted the cherry depiction in column 1 of row N+1 and therefore disturb what had heretofore been a winning combination.

Although the vectors and secondary game depicted reside "up" and "down" relative to the primary game, the game could be configured so as to include (or be depicted as) a secondary game on sides of the primary game (e.g., $C_{N+1}$, $C_{N+2}$) using side to side (i.e., horizontal) vectors.

Figure 4:
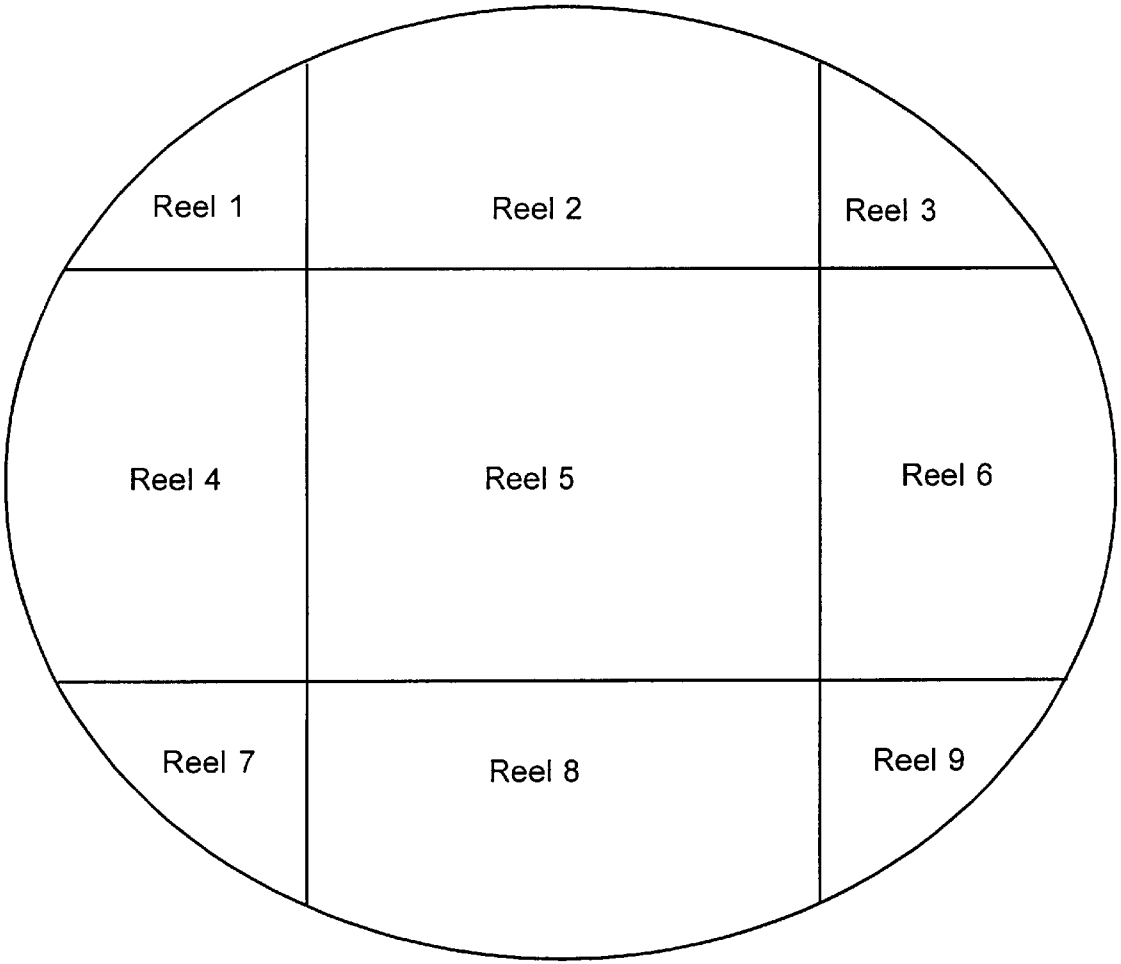
FIG. 4 shows a first bonus screen.

FIG. 4 reflects a second screen bonus situation which is enabled upon the occurrence of a certain outcome on the screen discussed in conjunction with FIG. 2. Upon an appropriate orientation of indicia in FIG. 2, the bonus screen of FIG. 4 can be enabled and preferably displaces the FIG. 2 depiction temporarily. In this version, the bonus is configured as a three by three reel display with the lines of the display preferably foreshortened, simulative of viewing one hemisphere of a globe. The three by three array defines nine sectors each of which simulate independent movement as though they were the video depiction of actual reels. Preferably, the message box 18 conveys a "goal" symbol which needs to be matched on the reel display. For example, an orange may appear as the goal. Also displayed in the message box is the maximum number of times the reels can be respun. The reels which have not coincided with the goal (e.g., the orange) respin either the maximum number of times or the bonus event stops when all symbols in the reel display conform to the goal symbol (e.g., nine oranges). An award follows. Alternatively, in place of the maximum number of respins allotted, the message box could convey a time allotted for respinning, e.g., 15 seconds.

Alternatively, a car, boat or racing motif may appear within the field of vision proximate the hemisphere and simulate by means of video graphics a competitive event which pits the player against other entrants in a race of boats, cars, airplanes, etc. While the race is in progress, the nine reels on the hemisphere rotate and each ultimately comes to a stop preferably correlative of an event associated with the race resulting in a fixed display of the nine sectors having indicia thereon which constitutes in one or more sectors (or a specific orientation of several sectors) a bonus award which enhances the pay out achieved from the game of FIG. 2. If the screen associated with the game is a touch screen the rotating indicia in each of the nine sectors can be stopped by a player touching the screen or, alternatively, each of the sectors can stop upon the occurrence of a condition such as passing a competitor or achieving a lap speed in excess of a certain milestone (e.g. a new single lap track record).

Figure 5:
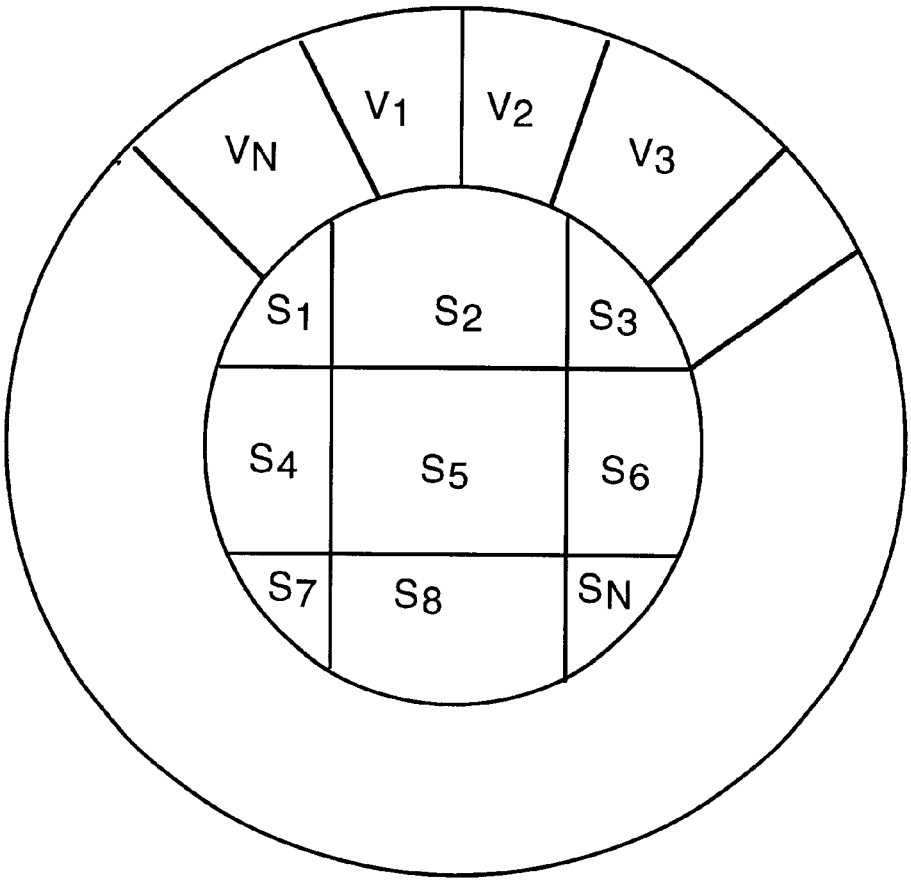
FIG. 5 shows a second bonus screen.

A second form of bonus game is shown in FIG. 5. In this variation, another matrix, preferably a three by three array is operatively coupled to and circumscribed by an annulus having a plurality of sectors each of which are provided with a numerical or symbolic value $V_1$, $V_2$, $V_3$ . . . $V_N$ and preferably coupled with sector illumination on the annulus so that one symbol or indicia at a time is illuminated. When a single value V is illuminated, a player would select which of the sectors $S_1$, $S_2$, $S_3$ . . . $S_N$ in the matrix is to receive that value V, preferably by using a touch screen (rather than buttons 6) as the directive. Upon successive selections, all the sectors in the three by three array has been filled based on the player's placement. Alignment of identical symbols in a row, along a diagonal or along a column cause those aligned identical values to "vanish" from the display triggering first a present bonus award and second allow the player the further opportunity to refill those sectors with (three more) elements as they become illuminated one at a time on the annulus. Optionally, the values can be placed in the matrix by the machine itself rather than by player directive.

Figure 6:
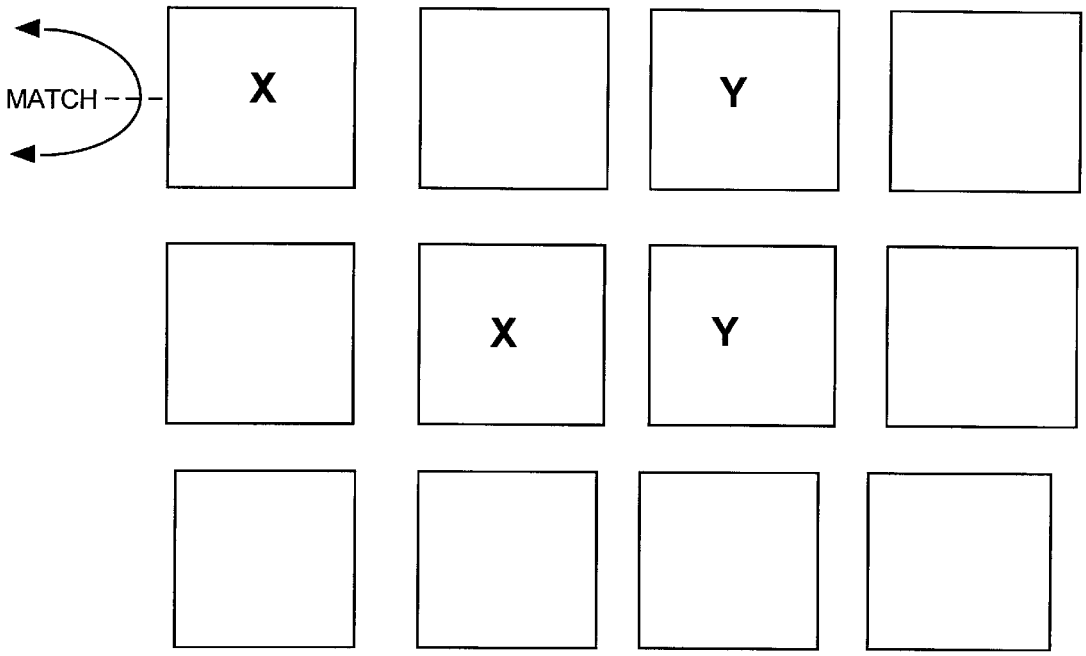
FIG. 6 shows a third bonus screen.

FIG. 6 reflects a further bonus arrangement in which a matrix, in this event depicted illustratively as a four by four array is defined by panels having symbols that are initially hidden, but can be sequentially exposed by the player touching the screen on the panel. The object of this bonus round is to pair up identical symbols. Once two panels have been touched and there is no match, the symbols are again hidden so that the player has to rely on the player's memory in order to recall where certain symbols exist upon further panel exposition. The object of this bonus game therefore is to match all of the symbols into pairs for an award. Once a pair is established, it is removed from the universe of choices available to the player.

In use and operation, the player enables the game by making a wager. If the magnitude of the wager is sufficient, the secondary display of FIG. 2 is enabled and the simulated reel rotation allows indicia from the primary display to be imported to the secondary display. Awards are due based on comparison of the rows (and optionally columns and diagonals) vis-à-vis a pay table posted on the machine. On the occurrence of a certain outcome, one of the three bonus screens is enabled and play of the bonus is performed as above delineated. The player is then prompted to play again and may be inclined to do so particularly when the secondary display indicia, which is not as volatile as the primary display indicia, reflects a pay out which is certain so long as a vector doesn't disturb the symbols that are associated with the pay out.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming device, comprising, in combination:

a primary game which includes a plurality of changeable primary indicia each of which changes on successive plays, some of said primary indicia including vector means on said primary indicia for indicating further indicia movement, a secondary game having indicia transferred from said primary indicia as dictated by said vector means, means to elect said secondary game, and means to award a player as a function of correspondence of said indicia as dictated by a pay table.

2. The device of claim 1 wherein said means to award a player is directed to said primary game.

3. The device of claim 1 wherein said means to award a player is directed to said secondary game.

4. The device of claim 1 wherein said means to award a player is directed to both said primary game and said secondary game.

5. The device of claim 1 wherein said vector means are only oriented in an upward direction.

6. The device of claim 1 wherein said vector means are only oriented in a downward direction.

7. The device of claim 1 wherein said vector means may be oriented in either an upward or a downward direction.

8. A method for gaming, including the steps of:

displaying a primary game after a wager, awarding certain outcomes of the primary game, enabling a secondary game and transferring indicia from said primary game as indicated by vectors on said primary game, awarding certain outcomes of the secondary game, changing the primary game display based on a subsequent wager, awarding certain outcomes of the primary game, enabling a secondary game and transferring indicia from said primary game as indicated by vectors on said primary game, awarding certain outcomes of the secondary game.

9. The device of claim 8 wherein said indicia are directed by said primary game using pointing indicia adjacent to said indicia that only point in an upward direction.

10. The device of claim 8 wherein said indicia are directed by said primary game using pointing indicia adjacent to said indicia that only point in a downward direction.

11. The device of claim 8 wherein said indicia are directed by said primary game using pointing indicia adjacent to said indicia that may point in either an upward or a downward direction.

12. A gaming device, comprising, in combination:

an RXC changeable primary display wherein R is a plurality of rows and C is a plurality of columns including vector indicia which appears on said primary display, a secondary display having means to receive said vector indicia from said primary display, and a bonus screen actuated upon the occurrence of at least one outcome from said displays.

13. The device of claim 12 wherein said bonus screen includes a goal to be attained and means to maximize incidences of said goal on said bonus screen.

14. The device of claim 13 wherein said maximizing means includes means to sequence said goal on an array such that optimum orientations of said goal result in bonus enhancement.

15. The device of claim 14 wherein a plurality of reels are respun in an attempt to match with said goal.

16. The device of claim 14 further including means to place a series of said goal into an array to form a pattern which correlates to an enhanced award.

17. The device of claim 14 further including an array having pairs of goals obscured from view and exposed two at a time, means to select two at a time, and means to remove matched pairs.

* * * * *